US010252100B1

(12) United States Patent
Nelson et al.

(10) Patent No.: US 10,252,100 B1
(45) Date of Patent: Apr. 9, 2019

(54) BIOMECHANICAL FOOT GUIDANCE LINKAGE

(71) Applicants: NUtech Ventures, Lincoln, NE (US); Madonna Rehabilitation Hospital, Lincoln, NE (US)

(72) Inventors: Carl A. Nelson, Lincoln, NE (US); Cale J. Stolle, Lincoln, NE (US); Judith M. Burnfield, Lincoln, NE (US)

(73) Assignees: NUTECH VENTURES, Lincoln, NE (US); MADONNA REHABILITATION HOSPITAL, Lincoln, NE (US)

( * ) Notice: Subject to any disclaimer, the term of this patent is extended or adjusted under 35 U.S.C. 154(b) by 0 days.

(21) Appl. No.: 15/299,031

(22) Filed: Oct. 20, 2016

Related U.S. Application Data

(60) Provisional application No. 62/243,995, filed on Oct. 20, 2015.

(51) Int. Cl.
*A63B 23/00* (2006.01)
*A63B 21/00* (2006.01)
(Continued)

(52) U.S. Cl.
CPC ..... *A63B 21/4034* (2015.10); *A61H 99/00* (2013.01); *A63B 21/154* (2013.01);
(Continued)

(58) Field of Classification Search
None
See application file for complete search history.

(56) References Cited

U.S. PATENT DOCUMENTS 5,195,935 A 3/1993 Fencel
5,279,529 A * 1/1994 Eschenbach ..... A63B 21/4049 482/51

(Continued)

FOREIGN PATENT DOCUMENTS

WO WO 2008/114291 A1 9/2008

OTHER PUBLICATIONS http://www.disneyresearch.com/project/mechanical-characters/, Jul. 22, 2013.

(Continued)

*Primary Examiner* — Stephen R Crow
(74) *Attorney, Agent, or Firm* — Jenkins, Wilson, Taylor & Hunt, P.A.

(57) ABSTRACT

A gait replication apparatus can include a scalable mechanical mechanism configured to replicate different gaits. The scalable mechanical mechanism can include, for example, a four-bar linkage, a pantograph, a cam/Scotch-yoke mechanism, and so forth. In some embodiments, the mechanical mechanism includes a beam rotating about an axis passing proximate to its center, with a foot pedal slidably coupled with the beam, and a timing chain/belt or cable pulley-pair coupled with the foot pedal and looped about the beam. A method can include decomposing a foot path defined by Cartesian coordinates into polar coordinates, and providing a mechanical support for a foot, where a first mechanism controls an angular position of the mechanical support with respect to a reference frame, and a second mechanism controls a radial distance of the mechanical support from the reference frame.

12 Claims, 16 Drawing Sheets

(51) Int. Cl.

| | |
|---|---|
| ***A63B 21/22*** | (2006.01) |
| ***A63B 22/06*** | (2006.01) |
| ***A63B 23/04*** | (2006.01) |
| ***A61H 99/00*** | (2006.01) |

(52) U.S. Cl.
CPC ..... *A63B 21/22* (2013.01); *A63B 21/4035* (2015.10); *A63B 22/0664* (2013.01); *A63B 23/0476* (2013.01); *A63B 2022/067* (2013.01)

(56) References Cited

U.S. PATENT DOCUMENTS

| | | | | | |
|---|---|---|---|---|---|
| 5,899,833 | A * | 5/1999 | Ryan | A63B 22/0664 | 482/4 |
| 5,947,872 | A * | 9/1999 | Ryan | A63B 22/001 | 482/51 |
| 5,989,163 | A | 11/1999 | Rodgers, Jr. | | |
| 6,099,439 | A * | 8/2000 | Ryan | A63B 22/001 | 482/51 |
| 6,176,814 | B1 * | 1/2001 | Ryan | A63B 22/001 | 482/51 |
| 6,302,830 | B1 | 10/2001 | Stearns | | |
| 6,923,745 | B2 | 8/2005 | Stearns | | |
| 7,022,049 | B2 * | 4/2006 | Ryan | A63B 22/001 | 482/51 |
| 7,104,929 | B1 | 9/2006 | Eschenbach | | |
| 7,887,465 | B2 | 2/2011 | Ufelman | | |
| 8,608,675 | B2 | 12/2013 | Cardile | | |
| 2003/0022763 | A1 * | 1/2003 | Ryan | A63B 22/001 | 482/51 |

OTHER PUBLICATIONS

Schmidt, Henning; Werner, Cordula; Berhnardt, Rolf; Hesse, Stefan; Kruger, Jorg: "Gait Rehabilitation Machines Based on Programmable Footplates", Journal of NeuroEngineering and Rehabilitation, Feb. 9, 2007.

Hesse, Stefan; Uhlenbrock, Dietmar; "A Mechanized Gait Trainer for Restoration of Gait", Journal of Rehabilitation Research and Development, vol. 37, No. 6, Nov./Dec. 2000, pp. 701-708.

"Argentine Father Helps Paralysed Son Walk", Aljazeera News, May 7, 2012.

Dusing, Stacey C.; Thorpe, Deborah E.: "A normative sample of temporal and spatial gait parameters in children using the GAITRite electronic walkway", ScienceDirect, Gait & Posture, 25(1), pp. 135-139, 2007.

Erdman, A.G. and Sandor, G.N., "Mechanism Design: Analysis and Synthesis", Engelwood Cliffs, NJ, 1984, pp. 427-429.

Corbridge, Laura M.; Goldman, Amy J.; Shu, Yu; Buster, Thad W.; Burnfield, Judith M.: "Clinician's Muscle Effort During Partial Body Weight Support Treadmill Training: Is It Hard Work?", APTA Annual Conference Abstracts; PT 2009: The Annual Conference and Exposition of the APTA, Jun. 10-13, 2009.

Burnfield, Judith M.; Irons, Sonya L.; Buster, Thad W.; Taylor, Adam P.; Hildner, Gretchen A.; Shu, Yu: "Comparative analysis of speed's impact on muscle demands during partial body weight support motor-assisted elliptical training"; Gait & Posture, pp. 314-320, 2014.

Hillman, Susan J.; Stansfield, Benedict W.; Richardson, Alison M.; Robb, James E.: "Development of temporal and distance parameters of gait in normal children", Gait & Posture, pp. 81-85, 2009.

A Meyer-Heim MD et al.: "Feasability of robotic-assisted locomotor training in children with central gait impairment", Developmental Medicine & Child Neurology, 49, pp. 900-906, 2007.

Ganley, Kathleen J.; Powers, Christopher M.: "Gait kinematics and kinetics of 7-year-old children: a comparison to adults using age-specific anthropometric data", Gait & Posture, pp. 141-145, 2005.

Nelson, Carl A.; Burnfield, Judith M.: "Improved Elliptical Trainer Biomechanics Using a Modified Cardan Gear", IDETC, DETC2012-70439, Aug. 2012.

Nelson, Carl A.; Burnfield, Judith M.; Shu, Yu; Buster, Thad W.; Taylor, Adam P.; Graham, Andrew: "Modified Elliptical Machine Motor-Drive Design for Assistive Gait Rehabilitation", J. Med. Devices, 2011.

Fasoli, Susan E.; Ladenheim, Barbara; Mast, Joelle; Krebs, Hermano Igo: "New Horizons for Robot-Assisted Therapy in Pediatrics", American Journal of Physical Medicine & Rehabilitation, Nov. 2012.

Stansfield, B.W.; Hillman, S.J.; Hazlewood, M.E.; Lawson, A.M.; Mann, A.M.; Loudon, I.R.; Robb, J.E.: "Normalisation of gait data in children", Gait & Posture, pp. 81-87, 2003.

Stansfield, B.W.; Hillman, S.J.; Hazlewood, M.E.; Robb, J.E.: "Regression analysis of gait parameters with speed in normal children walking at self-selected speeds", Gait & Posture, pp. 288-294, 2006.

Shyu, Jenq-Huey; Chen, Ching-Kong; Yu, Chen-Chi; Luo, Yi-Jhong: "Research and Development of an Adjustable Elliptical Exerciser", 13th World Congress in Mechanism and Machine Science, 2011.

At L. Hof: "Scaling Gait Data to Body Size", Gait & Posture, pp. 222-223, 1996.

American Community Survey, "Sex by Age by Ambulatory Difficulty", US Census Bureau, 2013.

Burnfield, Judith M.; Shu, Yu; Buster, Thad; Taylor, Adam: "Similarity of Joint Kinematics and Muscle Demands Between Elliptical Training and Walking: Implications for Practice", Physical Therapy, pp. 289-305, 2010.

Perry, Jacquelin, "Gait Analysis—Normal and Pathological Function", Slack Inc., Chapters 1-3, 2010.

Burnfield, Judith et al., "Impact of Elliptical Trainer Ergonomic Modifications on Perceptions of Safety, Comfort, Workout, and Usability for People With Physical Disabilities and Chronic Conditions", Physical Therapy, 2011.

Nelson et al., "Synthesis of a Rehabilitation Mechanism Replicating Normal Gait," 14th World Congress in Mechanism and Machine Science, pp. 1-8 (Oct. 2015).

* cited by examiner

BIOMECHANICAL FOOT GUIDANCE LINKAGE

CROSS-REFERENCE TO RELATED APPLICATIONS

The present application claims the benefit under 35 U.S.C. § 119(e) of U.S. Provisional Patent Application No. 62/243,995, filed Oct. 20, 2015, and titled "BIOMECHANICAL FOOT GUIDANCE LINKAGE." U.S. Provisional Patent Application No. 62/243,995 is incorporated herein by reference in its entirety.

FEDERALLY SPONSORED RESEARCH OR DEVELOPMENT

This invention was made with government support under Grant Number HD074820 awarded by the National Institutes of Health (NIH). The government has certain rights in the invention.

SUMMARY

A human gait replication apparatus can include a scalable mechanical mechanism configured to replicate different gaits. The scalable mechanical mechanism can include, for example, a four-bar linkage (e.g., with adjustable link lengths), a pantograph 100 (e.g., coupled with a Cardan gear), a cam/Scotch-yoke mechanism (e.g., with a beam oscillated by a cam), and so forth. In some embodiments, the mechanical mechanism includes a beam rotating about an axis passing proximate to its center, with a foot pedal slidably coupled with the beam, and a timing chain/belt or cable-pulley pair coupled with the foot pedal and looped about the beam (e.g., where the timing chain/belt or cable-pulley pair is coupled with a rocker arm of a four-bar linkage).

A method can include decomposing a foot path defined by Cartesian coordinates into polar coordinates, and providing a mechanical support for a foot, where a first mechanism controls an angular position of the mechanical support with respect to a reference frame, and a second mechanism controls a radial distance of the mechanical support from the reference frame (e.g., where the second mechanism can be adjusted independently of the first mechanism to scale the gait).

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Figure 1:
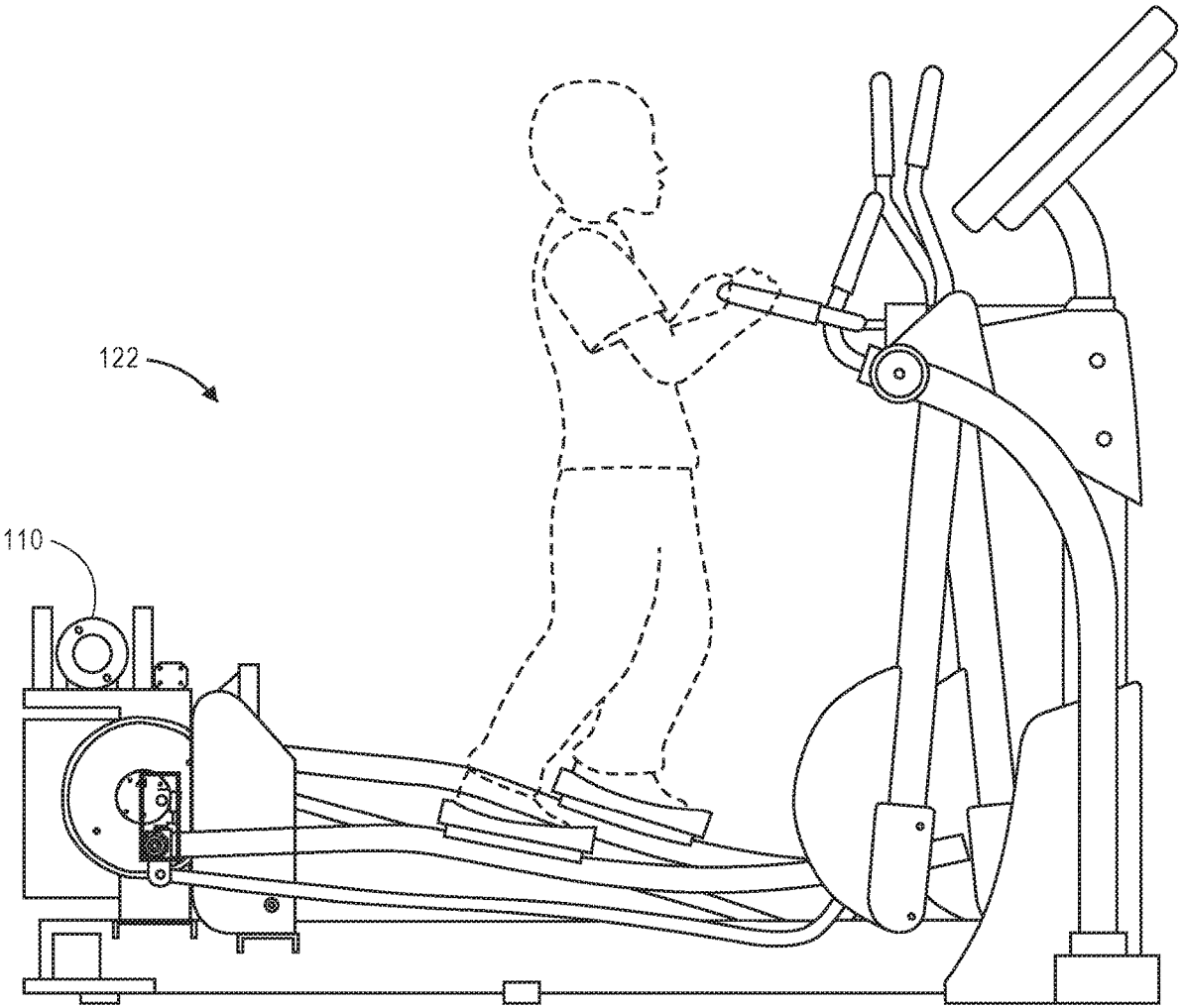
FIG. 1 is a side view illustrating a gait replication apparatus in accordance with an example embodiment of the present disclosure

Referring generally to FIGS. 1 through 21, gait replication apparatus 122 are described. Effective gait rehabilitation can be challenging, often requiring strenuous effort from a therapist, expensive technology, or both. One rehabilitation method involves assisting the patient's foot through a gait-like trajectory. While numerous devices have been developed to address the gait training needs of adults, these tools do not always scale well to meet the needs of a child's smaller body size. As described herein, gait-guidance devices can be scaled to address the gait retraining needs of individuals of varying body sizes from a child to an adult. Additionally, the gait-guidance devices can be used to vary gait-like trajectory for adults having varying therapeutic needs. For example, a shorter step length can be facilitated for a patient having, for example, limited range of motion due to a problem with hip flexion.

As described herein, a foot guidance linkage device can replicate biomechanically correct walking. The device can be used for gait rehabilitation, exercise, and/or cardiovascular fitness. The device can also scale motion for use by children and adults with varying step length. The device may use a decomposition of a foot path into polar coordinates (e.g., as opposed to Cartesian coordinates) so that scaling can be accomplished by controlling a single degree of freedom. Further, in some embodiments, the device can be bilaterally adjustable, facilitating independent step size/length adjustment for a foot on either side (right or left) of a user. In other embodiments, step size/length adjustment can be coupled together on both sides (right and left).

Gait (walking) impairments can be detrimental to health and mobility as they may contribute to trips and falls and limit access to community and social activities. In 2013, approximately 20.6 million Americans (7.1% of the population) had an ambulatory disability, of whom approximately 330,000 (1.6%) were children. To improve or sustain walking capacity, many individuals partake in physical rehabilitation programs that include intensive practice of gait-like activities. Clinicians and/or technology help guide the patient through repetitive gait cycles to strengthen not only the muscles important for walking, but also the neural connections that help control gait. One challenge is that sophisticated technology that has been developed for adults does not always scale well to meet the needs of those with smaller bodies (e.g., young, pre-pubescent children). As a result, clinics and school settings providing rehabilitation services for children may need to purchase separate equipment to address the needs of smaller versus larger stature children. This need for additional equipment can be difficult, particularly in light of budget and space constraints faced by many institutions. An affordable and scalable gait guidance system is described that can be used to address the walking needs of adults and children.

Children as young as two (2) years old demonstrate a kinematic gait profile that is very similar to that of adults. In some embodiments, normalization methods are used to compare pediatric data to standard adult gait. For example, children's gait data between ages five (5) and twelve (12) may be very consistent following normalization. Regardless of the velocity at which a child is travelling, there may be only minor differences in step length, cadence, and other factors. In some embodiments, normalized parameters may show no correlation between age and gait parameters after the age of about seven (7). Apparatus 122 and techniques described herein may be used with individuals ranging in age from about two (2) to about twelve (12) and upwards (e.g., depending, in some instances, upon the cognitive abilities of a particular child). For example, in some embodiments, gait-replication is provided for adults and children (e.g., where the children range in age from about four (4) years old to about twelve (12) years old, adults over sixty five (65) years old, etc.).

The foot is composed of a complex set of articulations across twenty-six (26) bones that are controlled by a myriad of muscles often spanning multiple joints. Due to the similarity of normalized paths, a single foot trajectory can be chosen and scaled to match the gait path of various leg lengths. However, unique points on the foot traverse different trajectories during gait. To simplify observational and biomechanical analysis of gait, the foot's trajectory can be simplified to include an analysis of the forefoot and rearfoot. Using this approach, the foot can be modeled as two hinged, rigid bodies. With the toes affixed to a solid surface, the metatarsal heads serve as the juncture between the two rigid bodies. A heel marker can provide a biomechanical reference for the proximal aspect of the rearfoot.

Figure 2:
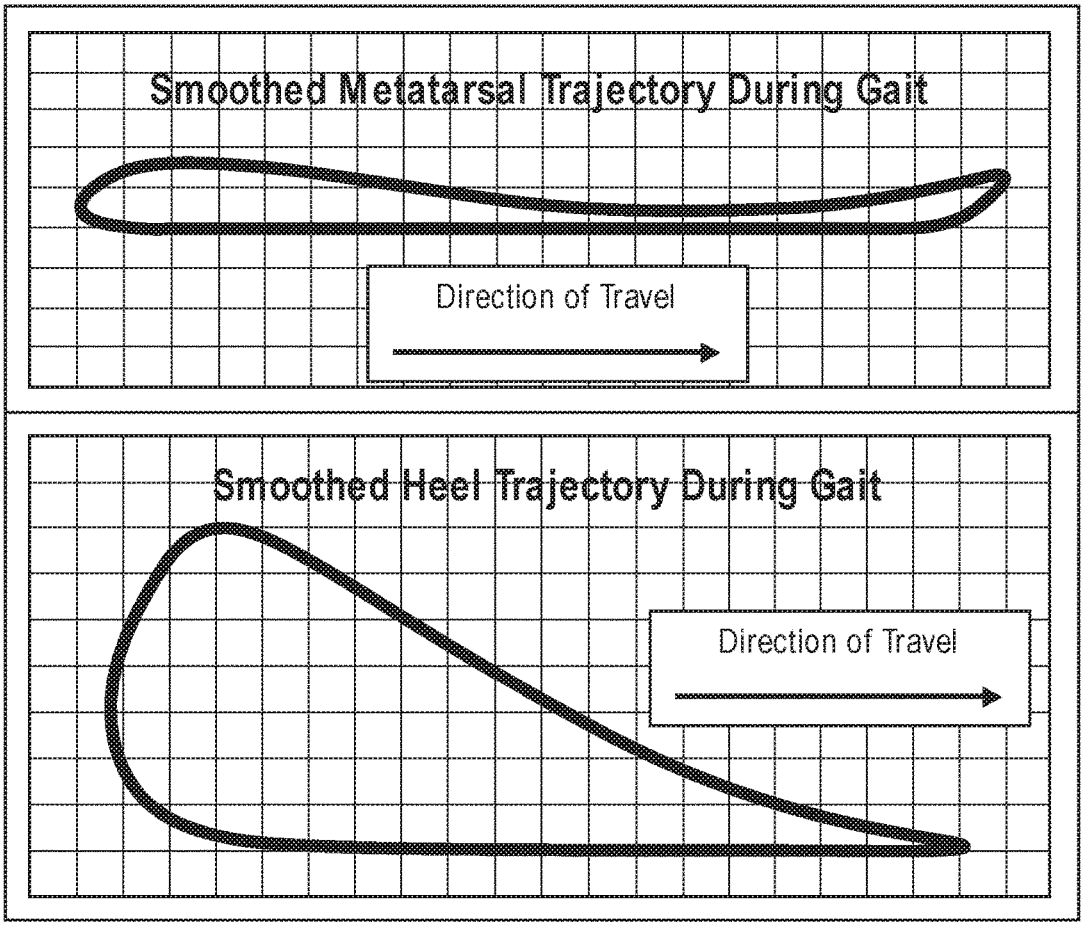
FIG. 2 is a graph illustrating smoothed, normalized trajectories of foot points in accordance with example embodiments of the present disclosure.

A normalized sample path of a child's third metatarsal and heel trajectory are shown in FIG. 2. These data are taken relative to the center of mass of the body, causing the trajectory to be a smooth, closed loop. In some embodiments, foot trajectory can be modeled by tracing the path of the metatarsal only. However, if the foot angle is taken into consideration, all points on the foot may travel through a gait-like trajectory. This tracking of one point vs. two points on the foot may be analogous to the difference between the path-generation and rigid-body-guidance problems in kinematic synthesis.

Currently, gait training methods may be expensive and/or labor-intensive, placing notable demands on the clinician's body to deliver the intervention. Treadmill and elliptical training are less expensive, but often require significant effort from a therapist and may require that the patient have significant strength to support themselves. To address this problem, gait rehabilitation techniques have been developed by researchers using treadmills with body weight support and robotic-assisted driven-gait orthoses. Gait training methods are usually specialized for different body sizes, meaning that different gait training devices are required for pediatric and adult gait therapy. Robotic gait-training devices can be extremely expensive, and readjusting link lengths to match leg parameters may be cumbersome. In addition, some potential gait training equipment options do not propel the foot through a gait-like trajectory, thus reducing task-specific training thought to be beneficial for strengthening not only the muscles, but also the neural pathways responsible for controlling movements.

Gait replication apparatus 122 are described herein that can be used by adults and children alike, accommodating a broad range of step lengths. Further, the apparatus 122 can be used in rehabilitation clinics, for in-home therapy, in hospitals, in schools and community centers, and so on. In some embodiments, the apparatus 122 can provide gait-like trajectory, where the mechanism constrains the feet to a trajectory similar to normal gait motion. Further, the apparatus 122 can be scalable to accommodate individuals with a step length between at least approximately twenty centimeters (20 cm) and at least approximately one hundred and two centimeters (102 cm) while producing a linearly-scaled gait trajectory, such that the size of the foot path is variable, but not its shape. Also, the entire scaling process may be performed by one actuator, eliminating the possibility of accidental misalignment or inaccurate mechanism trajectory.

In some embodiments, the apparatus 122 can be adjustable to accommodate specific impairments, such as different step lengths for each foot and/or reduced step heights. In some embodiments, the apparatus 122 can be cost-effective so that smaller rehabilitation centers and in-home users can afford to purchase the device. The apparatus 122 may also have a small footprint (e.g., not requiring excessive space to store or operate). In some embodiments, the apparatus 122 can be motorized. For example, a motor and/or other actuator can be used to propel a patient's foot through a gait-like trajectory. The motor component can be used to assist patients with low muscular strength. In some embodiments, the apparatus 122 can be back-drivable. For instance, a gait replication apparatus 122 can be manually driven without requiring significant effort, which can make it usable as an exercise device. In some embodiments, the apparatus 122 can also be ergonomic (e.g., not impairing the normal gait motion of the user, and avoiding uncomfortable interferences that may prevent effective rehabilitation). For example, the mechanism can mimic the trajectory of the foot during normal gait and create a comfortable, enjoyable exercise/rehabilitation experience.

A gait-like trajectory may be difficult to replicate mechanically. Without the use of multiple motors, a mechanical device that traces a highly nonlinear path may prove difficult to synthesize. Scaling and back-drivability may further complicate the mechanism. Example approaches for addressing these difficulties include replicating the path using a single, scalable, path-generating mechanism, and parametrizing the path and using multiple systems in tandem to produce the desired output. When using path-tracing mechanisms, one mechanism to drive the motion of the foot can make it far easier to provide back-drivability. Also, the simplicity of such mechanisms can make them more affordable and easier to construct.

In some embodiments, a four-bar (4-bar) linkage 144 can be used to produce a variety of paths. Several methods can be employed to fit the trajectory to a four-bar linkage 144, including nonlinear optimization, consulting a four-bar linkage coupler curve atlas, classical linkage synthesis for rigid-body guidance, and experimenting in simulation software. In some embodiments, best-fit methods for the long, flat shape of the metatarsal trajectory may result in an elliptical shape without a desired flatness. Thus, in order to scale the four-bar linkage 144 according to design requirements, each individual link may be scaled proportionately. For example, links with changing lengths can be provided using multiple motors. Other closed-loop mechanisms, such as six-bar (6-bar) and/or eight-bar (8-bar) linkages may also be used, allowing higher-order paths closer to a natural gait.

Figure 3:
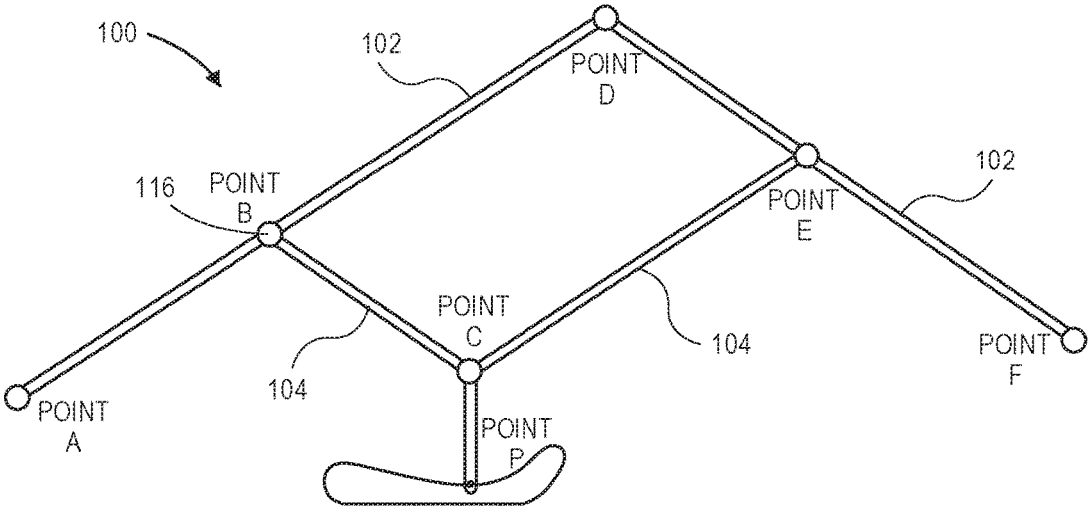
FIG. 3 is a side elevation view illustrating a gait replication apparatus configured as a pantograph using long linkages in accordance with example embodiments of the present disclosure.
Figure 4:
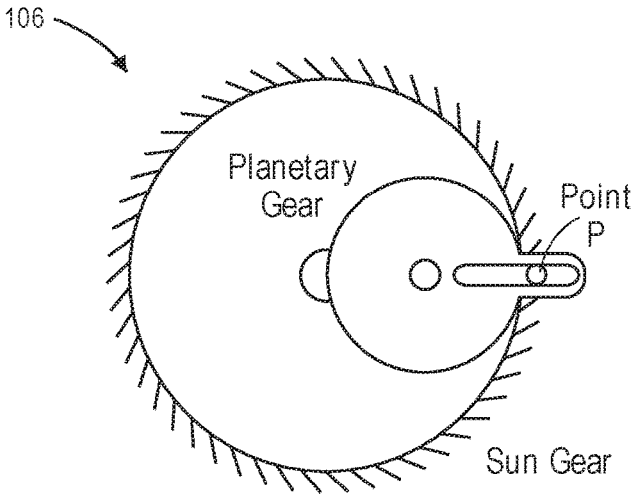
FIG. 4 is a side elevation view illustrating a gait replication apparatus for powering a point P through a gait-like trajectory in accordance with example embodiments of the present disclosure.

Pantograph 100*s* rely on geometrical constraints of similar triangles or parallelograms to produce similar motions at different points on a linkage. A pantograph 100 design can be generated by tracing the trajectory of the foot (e.g., from a template) and then mapping out an identical (or substantially identical), scaled path for the foot. In one design, two long beams 102 connect with two shorter beams 104 to create a scaling mechanism, as shown in FIG. 3. Triangles ABC and ADF are similar. Point A is rigidly attached to the ground, and point F is attached to a foot pedal 118. Point C attaches to a pin (Point P) that rolls in a track that matches the gait path. To power the pin through the track, a Cardan gear 106 can be used, as shown in FIG. 4. Cardan gears 106 can generate elliptical trajectories with similarities to gait paths. Since the desired path is not a true ellipse, the mechanism can use a sliding connection between Point P and the Cardan gear 106. This can allow the pin to follow the gait path and not be constricted to an elliptical trajectory.

Figure 5:
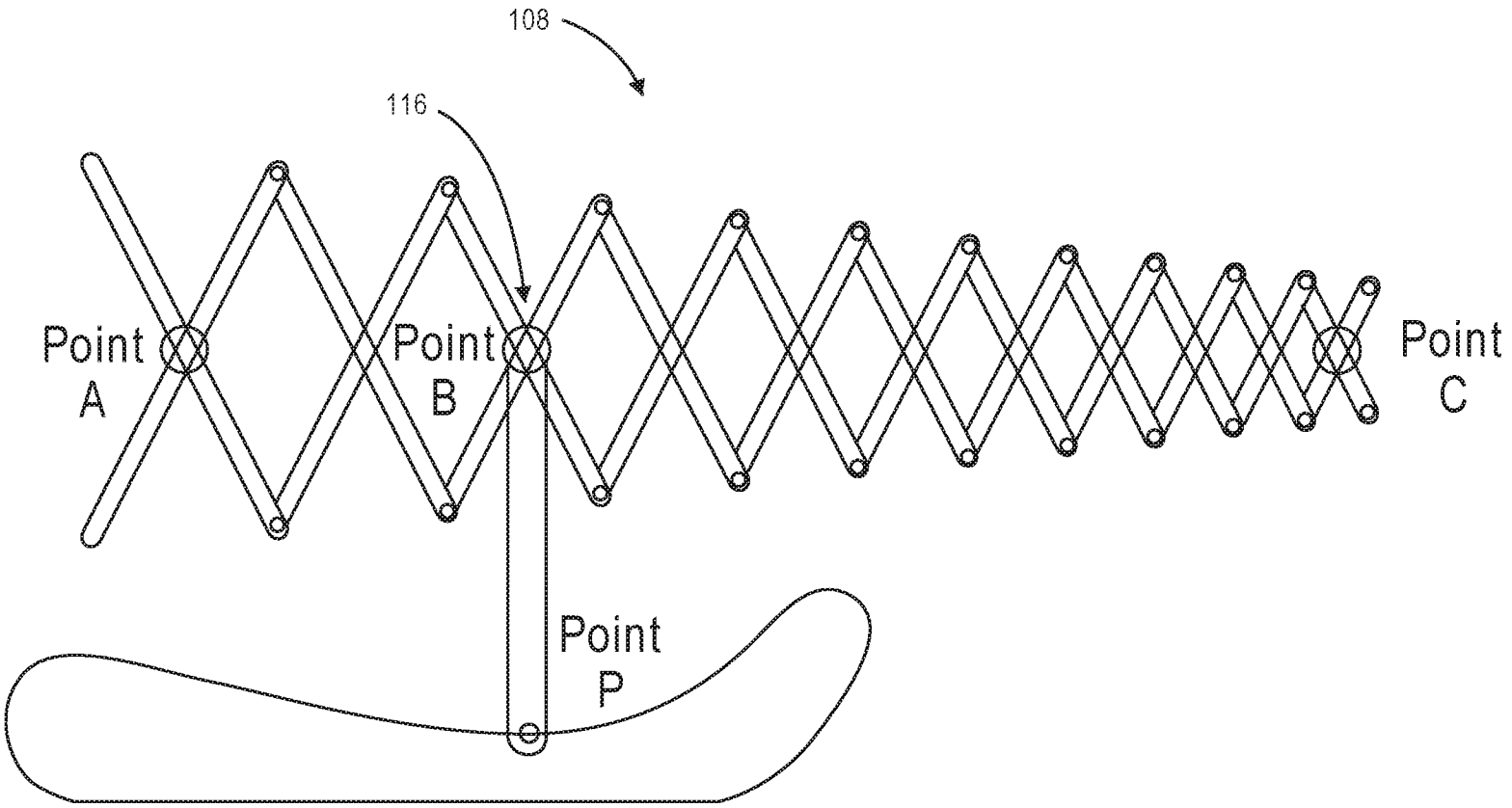
FIG. 5 is a side elevation view illustrating a gait replication apparatus configured as a pantograph using short linkages in accordance with example embodiments of the present disclosure.

However, this pantograph 100 design is provided by way of example and is not meant to limit the present disclosure. In other embodiments, different pantograph 100 implementations can be used to generate a gait path. In this manner, accurate gait trajectory tracing can be provided. To obtain scaling, a motor can be used to change link lengths so that the geometric similarities of the triangles can be preserved. In some embodiments, a telescoping pantograph 108 extends outward, as shown in FIG. 5. Again, point A is rigidly attached to the ground, and point B (116) traces the gait path similar to the embodiment shown in FIG. 3. The foot pedal 118 is located at point C. In order to scale the motion, point C can be moved to different joints along the pantograph 100 assembly. This implementation can provide discrete, accurate scaling, although the scaling may not necessarily be linear.

Figure 6:
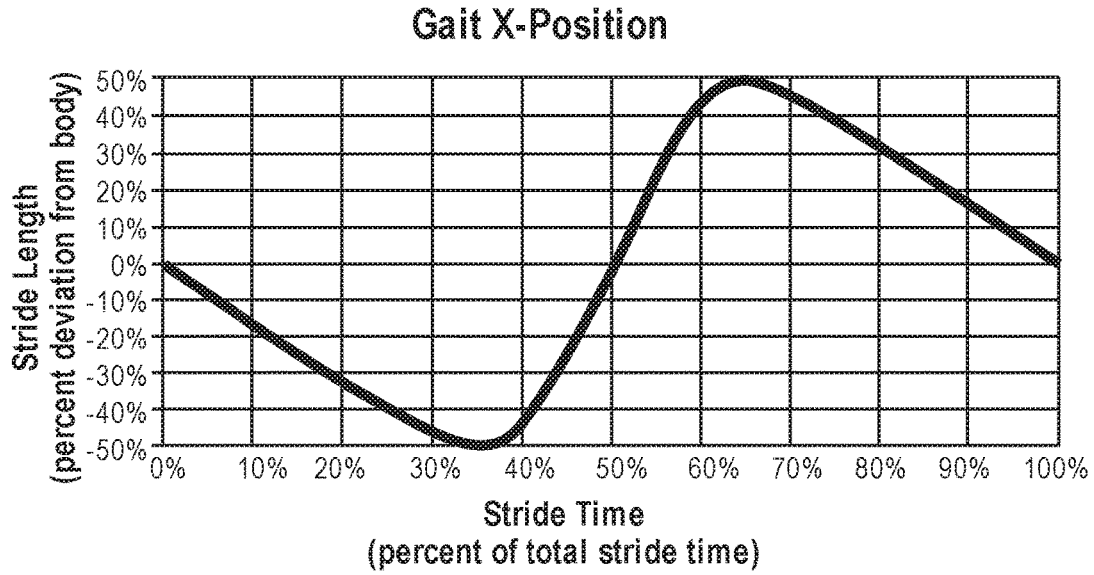
FIG. 6 is a graph illustrating Cartesian coordinates of metatarsal trajectory during gait in accordance with example embodiments of the present disclosure.
Figure 6:
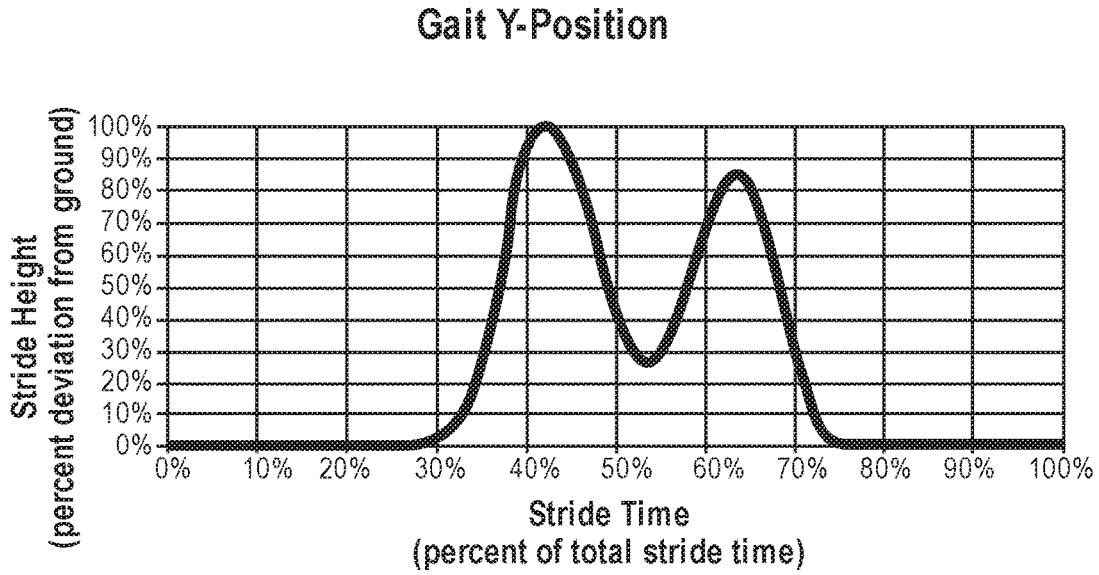
Figure 7:
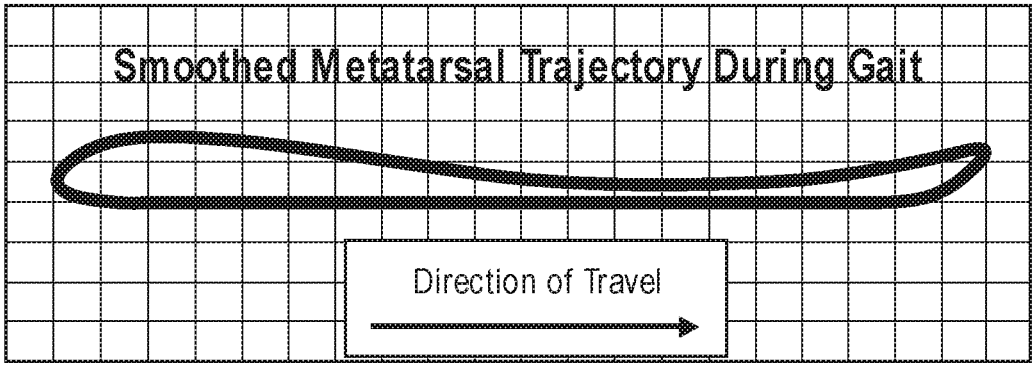
FIG. 7 is a graph illustrating polar coordinates of metatarsal trajectory during gait in accordance with example embodiments of the present disclosure.
Figure 7:
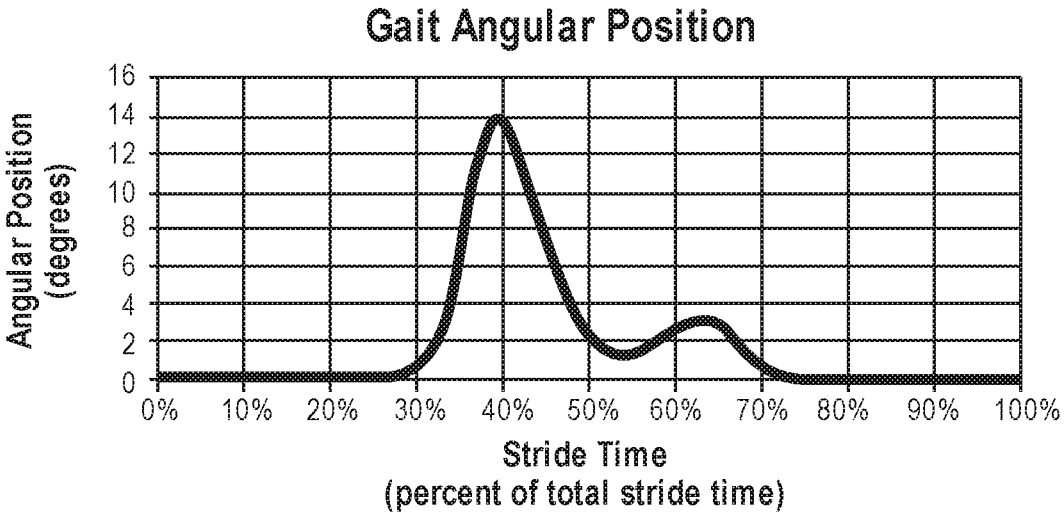
Figure 7:
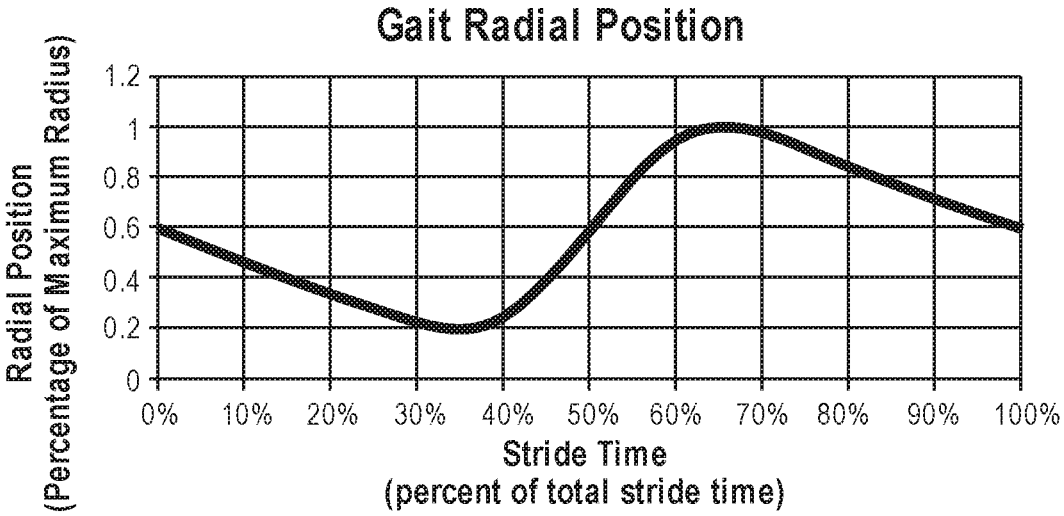

In some embodiments, gait path can be separated into Cartesian coordinates, where each coordinate is a function of time. For example, the X-position and Y-position coordinates of the metatarsal trajectory are separated, and the graphs of these variables are shown in FIG. 6. Both X-position and Y-position coordinates may be highly nonlinear functions of time, but separating the X and Y positions can allow independent mechanisms to be used to control the horizontal and vertical motions of a foot pedal 118. This technique may be simpler than constructing a single mechanism that generates the entire path. Scaling in Cartesian coordinates may be cumbersome for this scenario. Thus, in some embodiments, parametrization in polar coordinates can be used. In a parametrized system, one mechanism can control the angular position of a point relative to a fixed reference frame, while another mechanism can control the radial position. With the angle held constant, the radius of an arc and the arc length are linearly correlated, meaning that simple scaling of the radial position scales the entire trajectory. The coordinates are highly sensitive to the location of the origin. If the origin is placed inside the closed loop, the angular position may undergo a complete revolution. If the origin is outside of the loop, the angular position may oscillate. In some embodiments of a parametrized implementation, the origin is located at a point just outside of the loop at a point on the ground. An example trajectory of this configuration is shown in FIG. 7.

Figure 8:
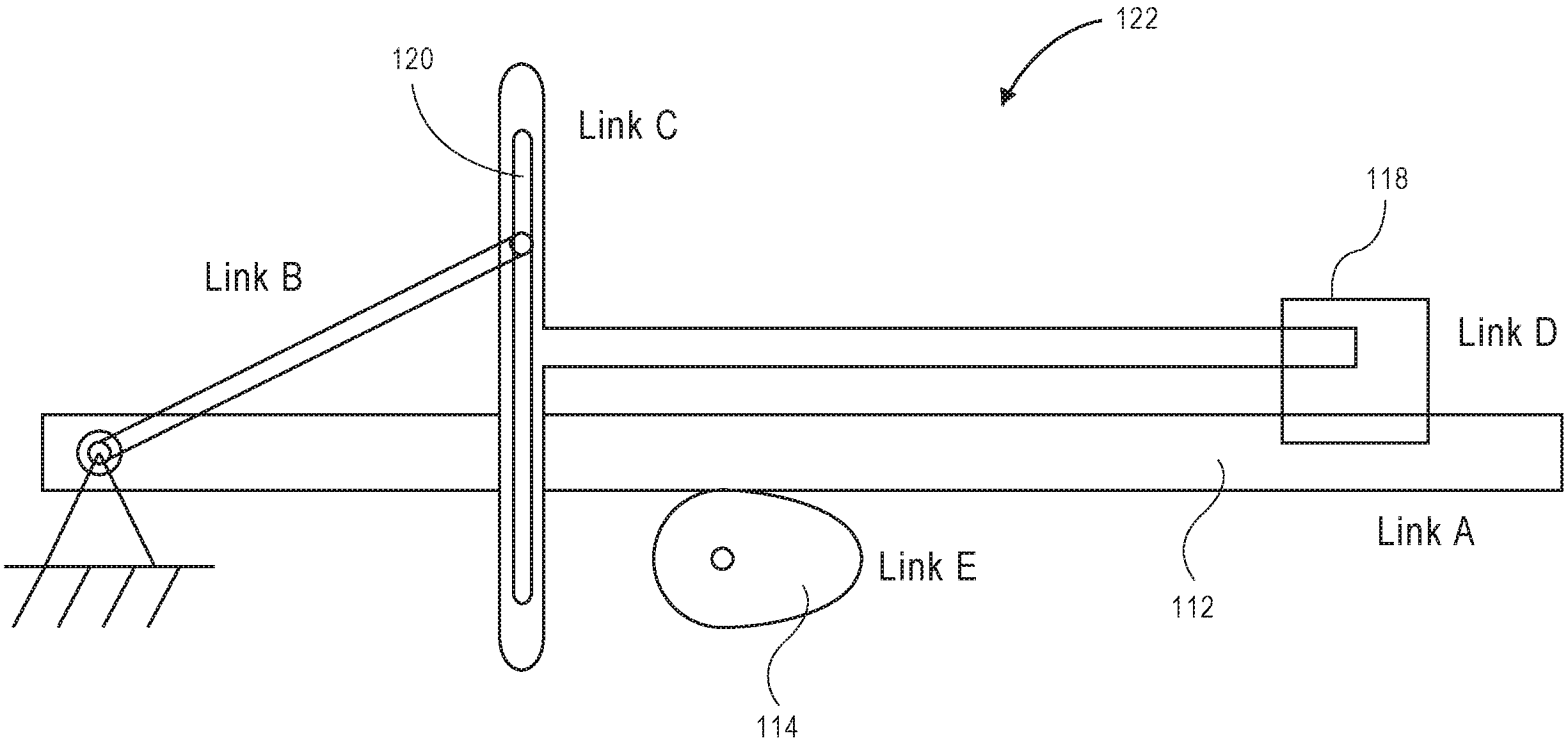
FIG. 8 is a side elevation view illustrating a gait replication apparatus configured as a cam/Scotch yoke mechanism in accordance with example embodiments of the present disclosure.

In some embodiments, a definition in terms of radial and angular coordinates allows for a parametrically defined, scalable mechanism. As shown in FIG. 8, a beam 112 (link A) is oscillated up and down by a cam 114 (link E) about its connection with Link B. This defines the angular position of the beam 112. Rotating link B defines the radial position of the foot pedal 118 (or carriage) (link D), which is sliding along the beam 112. By interfacing with the slot 120 in link C, link B is able to drive the radial position with the offset from zero as seen in FIG. 8. In a linearly-scaled system, the angular position may not necessarily change, and the radial position can be adjusted to produce proportional changes in stride length and trajectory. This may be performed by lengthening or shortening link B, although this may also require adjusting the offset (link C). In some embodiments, this configuration may use simultaneous adjustment of two links (e.g., rotating link B and the offset attached to link C). Further, the apparatus 122 described with reference to FIG. 8 may be back-drivable and ergonomic, and simple geared connections between link B and link E can allow the mechanism to be driven by a single motor 110 per foot pedal 118.

The strengths of the cam/Scotch-yoke mechanism are also used in the implementation described next. In the previous cam/Scotch-yoke mechanism, the offset included in link C was used because the origin of the polar coordinate system defining the angular and radial positions was set on the ground away from the trajectory. If the polar coordinate origin is placed on the trajectory, then no offset is necessarily used. However, if the origin is placed anywhere on the system, it may encounter angles exceeding 90 degrees (90°), where the mechanism would flip orientations. It is possible to place the polar coordinate origin on the gait path if the gait path intersects the origin. In the previous mechanisms described, the gait path is assumed to be the metatarsal trajectory. Both the metatarsal trajectory and the heel trajectory shown in FIG. 2 are smooth, cusp- and loop-free paths. However, a different point on the foot may experience a trajectory that is tangent to itself. The bottom of the foot can be defined by a line connecting the metatarsal and the heel. The position of every point on the bottom of the foot can be found using simple interpolation. To find the trajectory of point O on the foot, located on a vector traveling from the metatarsal to the heel, the following equation is used:

$$\hat{X}_O=(1-p)\hat{X}_{metatarsal}+p\hat{X}_{heel}$$

where X is the vector defining the horizontal and vertical position of the trajectory at any time and p is the percent distance from the metatarsal to the heel where the desired point is located on the foot.

Figure 15:
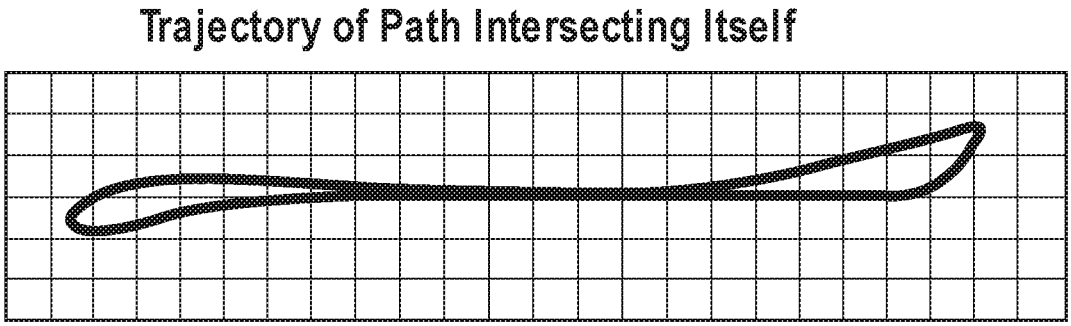
FIG. 15 is a graph illustrating trajectory of a foot point located in front of a toe in accordance with example embodiments of the present disclosure.

Using the above equation, it is apparent that when p=−0.25, the path is tangent to itself at the origin, as shown in FIG. 15. The position of point O, located at −25% of the distance from the metatarsal to the heel, occurs just in front of the toe on the foot. In healthy individuals, the toe joint flexes, causing the toe to diverge from the trajectory shown. If the mechanism accounts for foot orientation, then as long as the foot is placed in the correct location on the foot pedal 118, the foot will travel through a gait-like trajectory.

Figure 9:
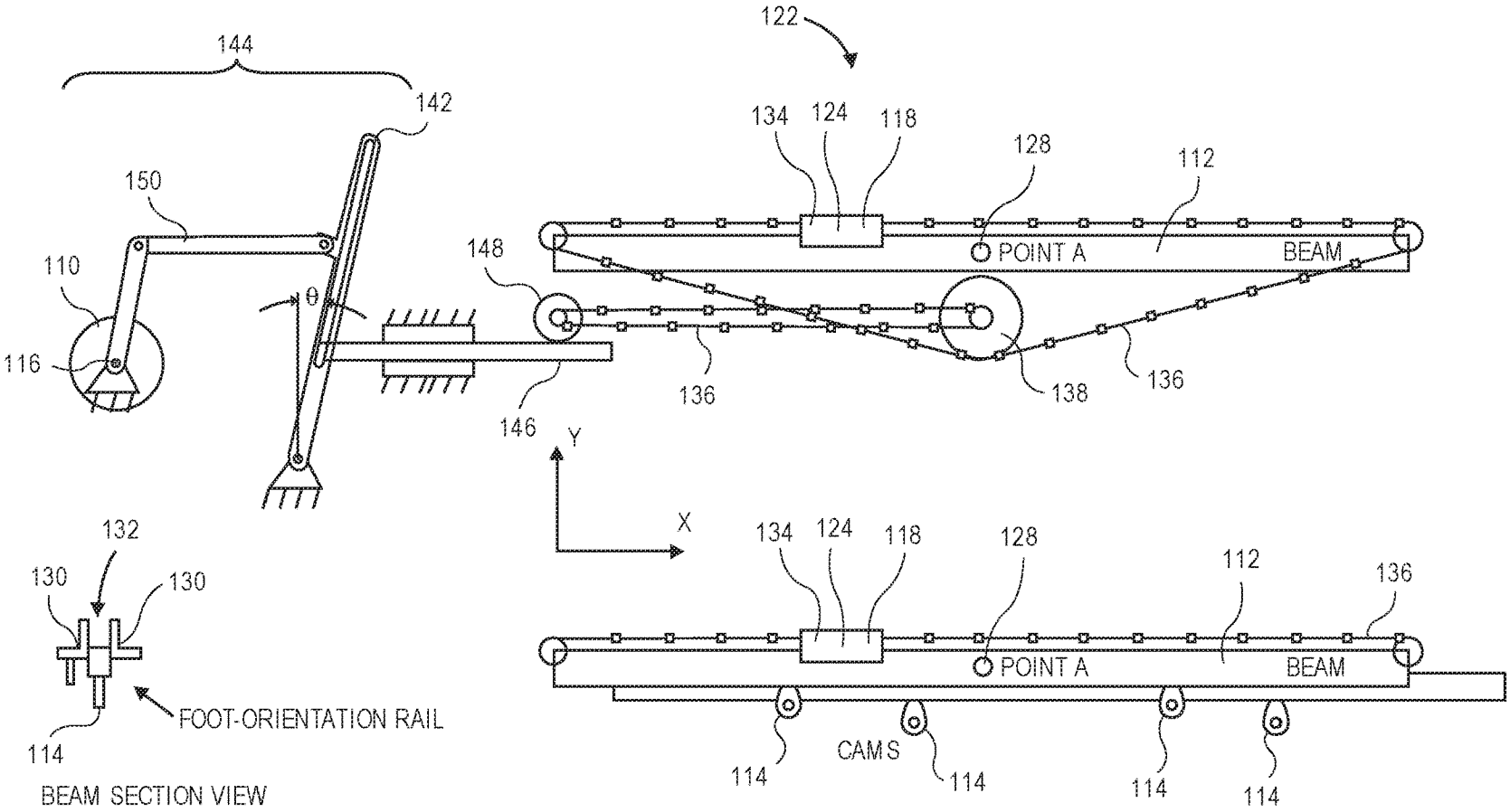
FIG. 9 is a side elevation view illustrating a gait replication apparatus in accordance with example embodiments of the present disclosure.

In some embodiments, a gait replication apparatus 122 includes a beam 112 rotating about an axis passing proximate to (e.g., through or near) its center 128 (e.g., Point A), as shown in FIG. 9. The beam 112 can include two L-shaped channels 130 separated by a small gap 132. A slider 134 (e.g., foot pedal 118) travels along the top of the beam 112, and the front-toe position of the slider 134 can be constrained to the beam 112. The slider 134 can be connected to a chain 136 coupled with a sprocket 138 (or a timing belt coupled with a pulley, etc.) that loops around the beam 112, which can propel the foot pedal 118 forward and backward. The chain 136 can be connected through gears (e.g., rack 146 and pinion 148) to the rocker arm 142 of a four-bar linkage 144. The rocker arm 142 can rotate at angle θ (theta) relative to the vertical axis, as shown in FIG. 9. The oscillations of the rocker arm 142 may cause the chain 136 to travel forward and backward along the beam 112, with timing matching that of a natural gait.

To scale the radial distance that the foot pedal 118 travels, the vertical position of the rack 146 and pinion 148 can be shifted. Moving the rack 146 along the rocker bar means that angular rotations of the rocker may result in larger or smaller horizontal displacement of the rack. Because the arc distance and radial distance are correlated, changing the position of the rack's connection to the rocker arm 142 can linearly scale the motion. The crank 150 of the four-bar linkage 144 can be connected through gearing to a cam 114 that defines the beam's 112 angular position. The angular position of the beam 112 (e.g., a first beam), combined with the radial position defined by the chain movement, can create the trajectory seen in FIG. 15. To capture the foot angle, the foot pedal 118 can be connected to a second beam. The second beam can rotate about Point A with the main beam 112, and can be raised and lowered through a cam. The vertical displacement of the second beam may cause the angle of the foot pedal 118 to change regardless of the position of the foot pedal 118. This can make the foot angle motion independent of the scaling.

Figure 10:
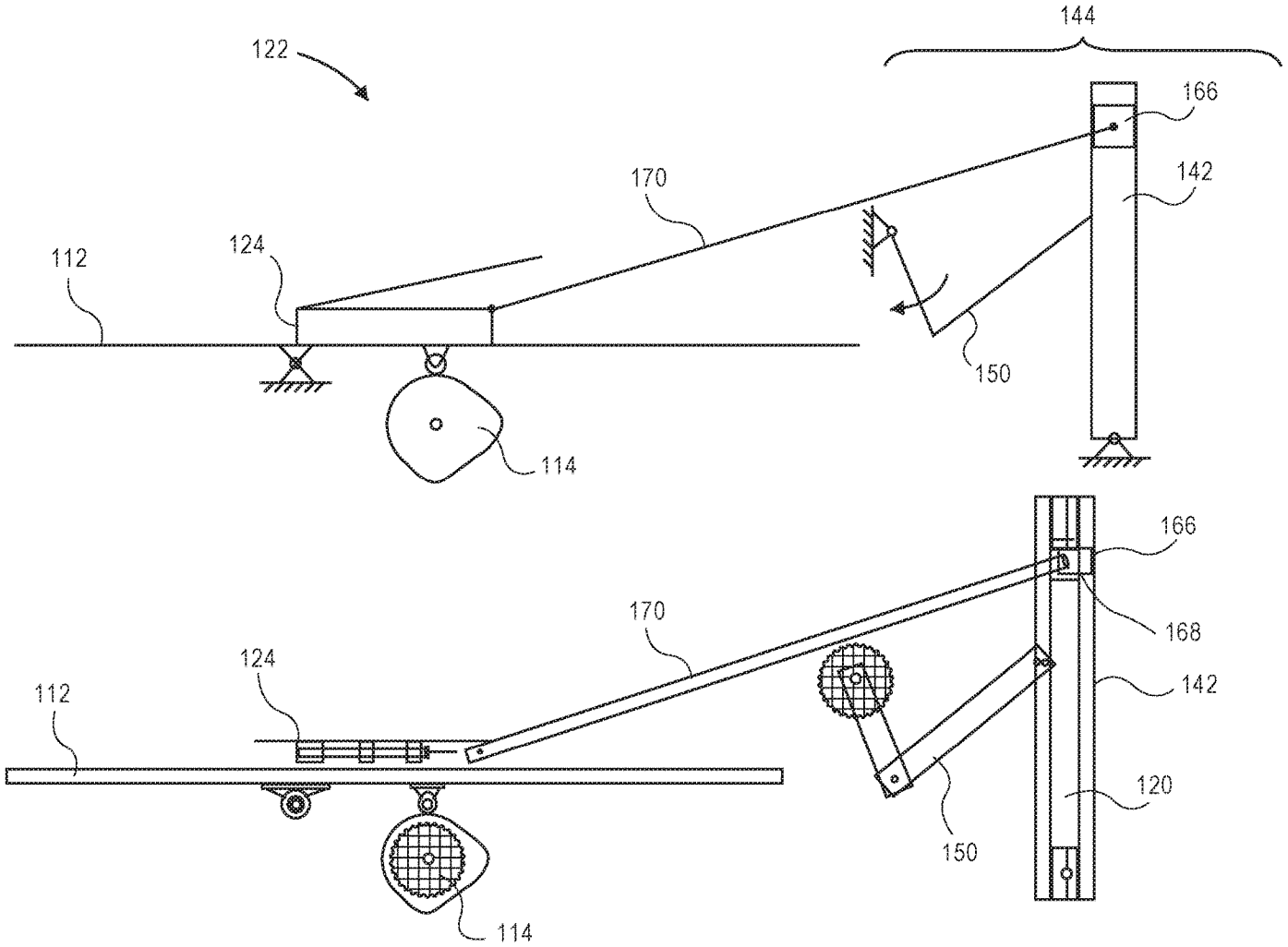
FIG. 10 is a side elevation view illustrating a gait replication apparatus in accordance with example embodiments of the present disclosure.

FIG. 10 illustrates one specific implementation of a gait replication apparatus 122. In this implementation, the gait replication apparatus 122 can include a crank-rocker four-bar linkage 144, which forms the foundation. A four bar linkage 144 can include a rocker 142 (as used herein, rocker arm can be interchangeable with rocker), a crank 150, and a connector 166 (e.g., block 166). The block 166 can be slidable along the rocker 142 (e.g., the rocker 142 can include a slot 120 in which the block 166 can slide), and the block 166 can be fixed with a pin 168. In one specific embodiment, the block 166 can be slidable along the rocker 142 (e.g., and can be fixed with a lead screw nut). In another specific embodiment, the rocker 142 can include a plurality of holes positioned along the rocker 142, where the block 166 can be fixed to the rocker 142 using a pin 168 and one of the plurality of holes. The block 166 can be coupled to a bar 170 that is coupled to a carriage 124. The carriage 124 can carry off-axis loading from the four bar linkage 144 and transmit the loading into longitudinal motion along the pivoting beam 112 (or rail). At least one cam 114 drives angular displacement of the beam(s) 112, and the cam 114 rotation can be coupled to the crank 150 of the four bar linkage 144. In this embodiment, the gait replication apparatus 122 forms a cam-constrained seven-bar linkage with one degree of freedom. The top figure in FIG. 10 illustrates a line diagram for power transmission of the gait replication apparatus 122.

Figure 11:
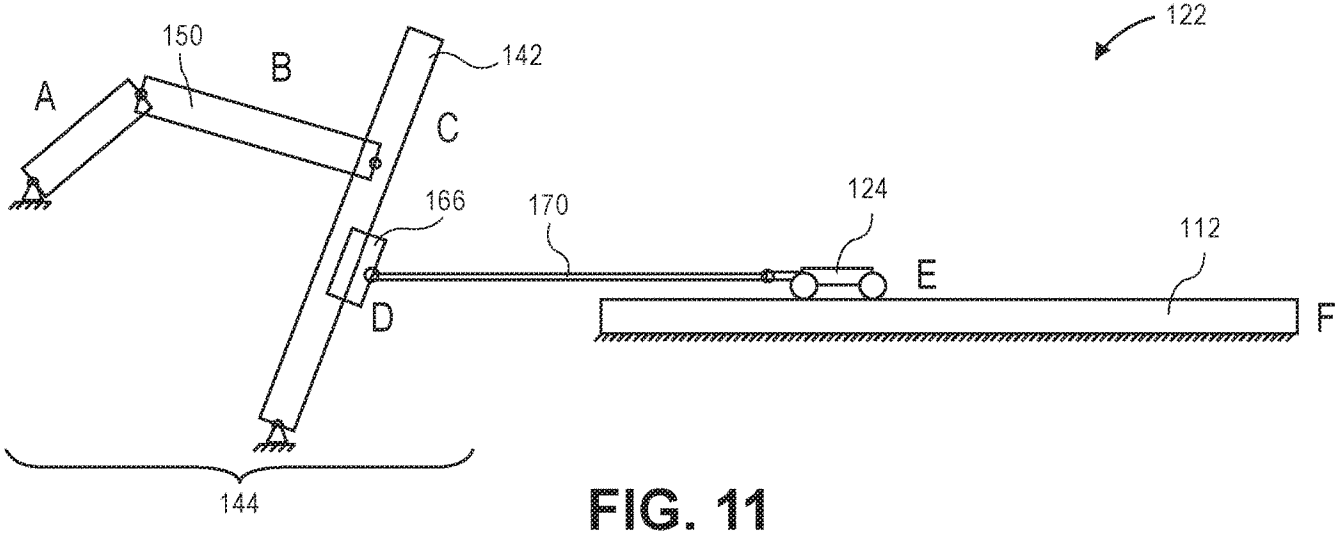
FIG. 11 is a side elevation view illustrating a gait replication apparatus in accordance with example embodiments of the present disclosure.

FIG. 11 illustrates one specific implementation of the gait replication apparatus 122. Instead of a mobile, pivoting rail as previously described, the rail can include an immobile beam 112 (F) that the carriage 124 (E) can travel upon. In this implementation, carriage motion is dictated by a four-bar linkage 144 (A-B-C). A sliding linkage (D) (e.g., block 166) on the rocker 142 (C) scales the carriage longitudinal movement.

Figure 12:
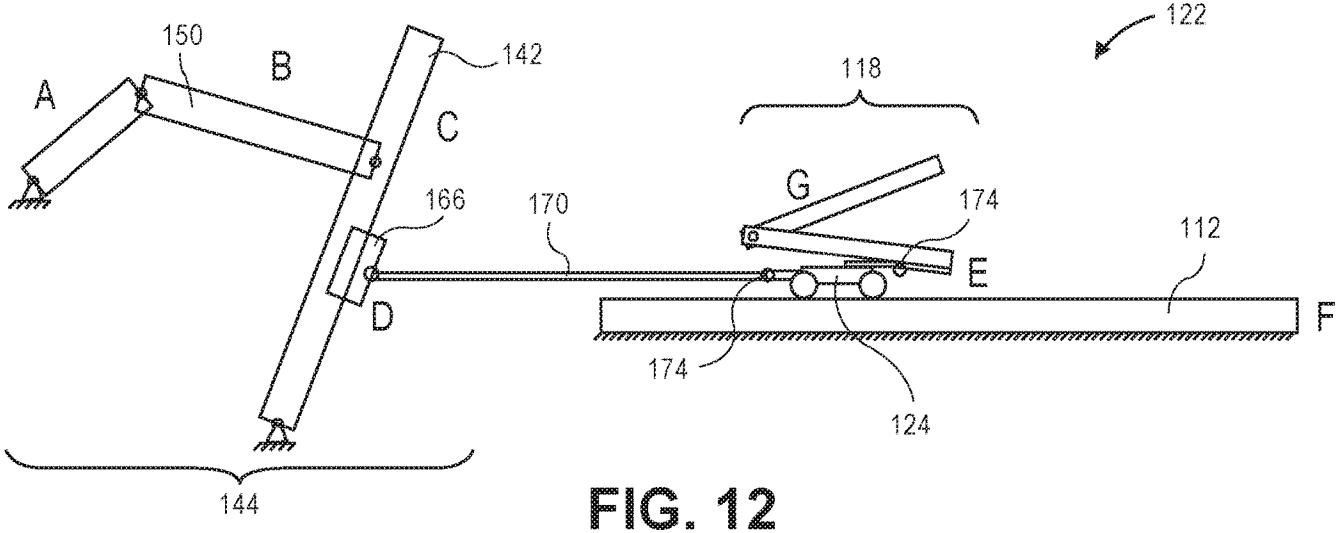
FIG. 12 is a side elevation view illustrating a gait replication apparatus including a foot pedal in accordance with example embodiments of the present disclosure.
Figure 13:
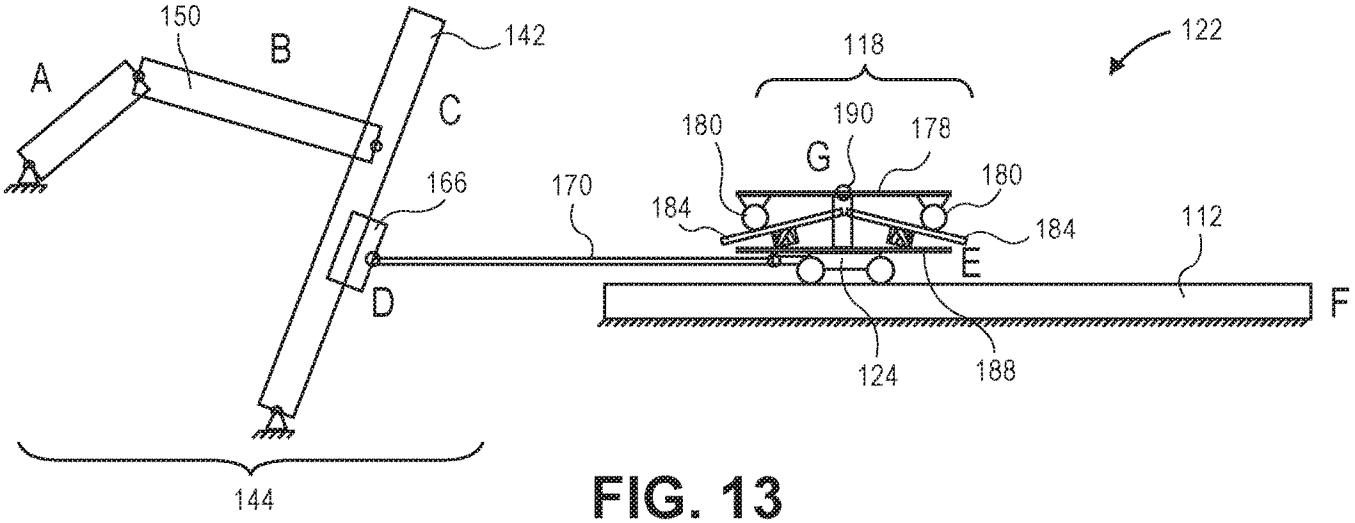
FIG. 13 is a side elevation view illustrating a gait replication apparatus including a foot pedal in accordance with example embodiments of the present disclosure.
Figure 14:
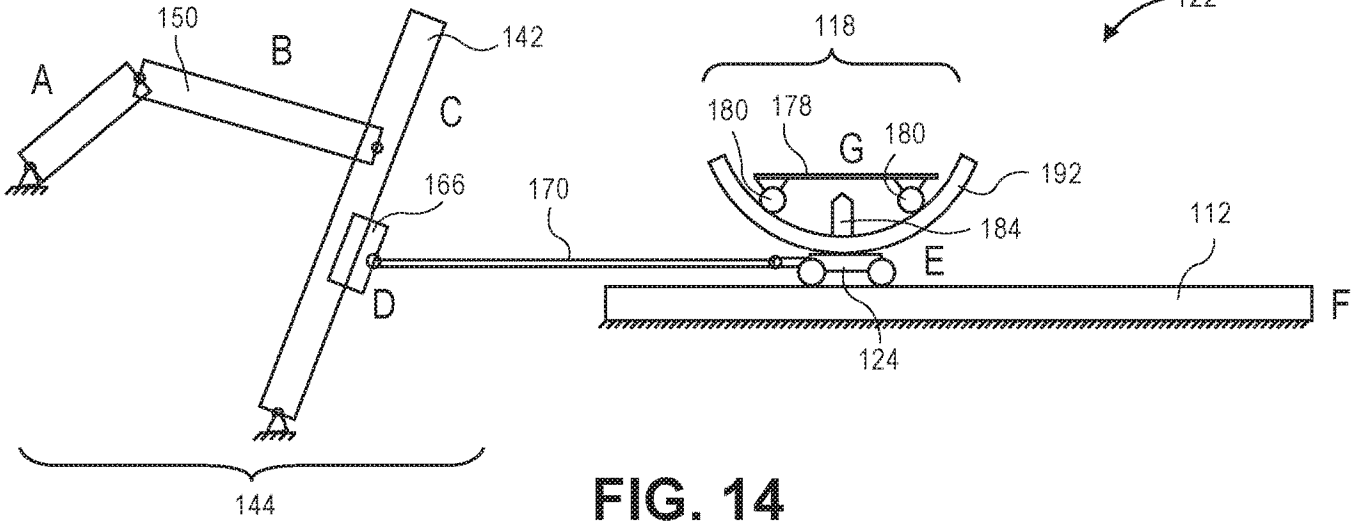
FIG. 14 is a side elevation view illustrating a gait replication apparatus including a foot pedal in accordance with example embodiments of the present disclosure.

Additionally, different embodiments of a foot pedal 118 are illustrated in FIGS. 12 through 14. In the embodiment shown in FIG. 12, the foot pedal 118 includes at least one rod (e.g., bar 170) that is connected to the carriage 124 through a revolute joint 174. Two more rods 176 can be joined to the carriage 124 using at least one revolute joint 174, and the revolute joint 174 can be configured such that it moves along the foot pedal 118. The distance between the two revolute joints can be adjusted to be consistent with the distance between the heel and the metatarsal of a patient.

In the embodiment illustrated in FIG. 13, the foot pedal 118 includes a pivoting plate 178 with at least one wheel 180 attached to the pivoting plate 178. Additionally, the foot pedal 118 includes at least one actuator 184 disposed between the at least one wheel 180 and a foot pedal base 188. Rotation of the pivoting plate 178 is lockable when the actuator(s) 184 is/are activated and pushed into the wheel(s) 180, and where the actuator(s) 184 deactivate and release the at least one wheel 180 during a swing cycle and allow the pivoting plate 178 to pivot about the pivot 190 on the center point. During the swing phase, the actuator(s) 184 can deactivate, and the pivoting plate 178 can freely pivot about the center point to the desired foot angle during heelstrike and the desired foot angle during toe off.

In the embodiment illustrated in FIG. 14, the foot pedal 118 includes a foot plate 194 with u-groove wheels 180 attached to it and a curved arc rail 192 coupled to the carriage 124 using a locking actuator 184. The locking actuator 184 engages the bottom of the foot plate 194 and disallows the foot plate 194 from moving. The actuator 184 can unlock during the swing phase. The foot plate 194 can be designed such that the heel and metatarsal can be located equidistant from each of the wheels 180 on the foot plate 194. The center of the curved arc rail can be disposed at a position very near to the ankle, where both the heel and metatarsal pivot about during a normal stride. When the actuator 184 is unlocked, pressure on the metatarsal (during toe off) causes the rear of the foot to rise. Pressure on the heel (during heel strike) causes the toe of the foot to rise. The fluidity of the foot pedal 118 encourages a user to engage in natural foot motions.

Figure 16:
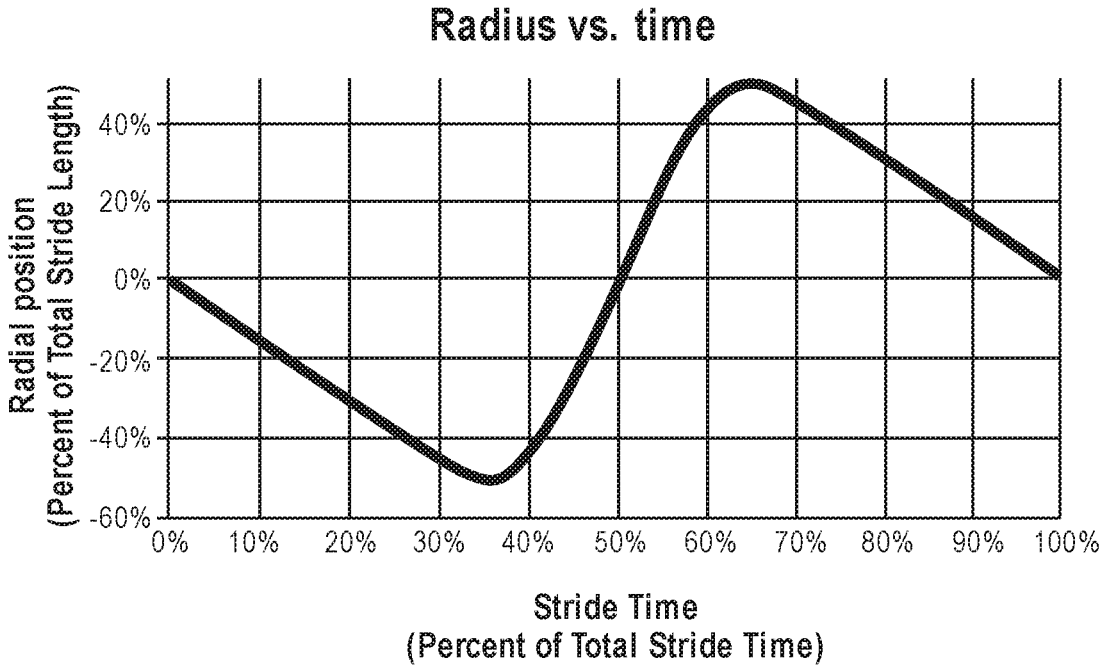
FIG. 16 is a graph illustrating foot pedal radial distance in accordance with example embodiments of the present disclosure.

The four-bar linkage 144 may be designed to replicate the radial position with respect to time, mimicking normal gait. The radial trajectory of a foot pedal 118 is shown in FIG. 16. To convert between radial distance and rocker arm 142 angle, the coordinates can be converted from Cartesian to polar form. The radial movement is directly influenced by the motion of the rack. The rack 146 is constrained to only move horizontally. From polar coordinates:

$$x=r*\sin(\theta)$$

$$y=r*\cos(\theta)=\text{constant}$$

where x is the radial distance of the rack, y is the vertical position of the rack, r is the distance from the rotation point of the rocker arm 142 to the connection point to the rack, and θ is the angular displacement of the rocker arm 142 from the neutral position. The y-position is constant here during operation of the machine. Vertical motion of the rack 146 causes the rack trajectory to scale. Thus, the rack 146 can be held at a constant height, and the distance r can be variable, dependent on θ. Rearrangement and combination of the equations solves for θ in terms of x and y:

$$\theta = \tan^{-1}\frac{x}{y}$$

In some embodiments, to limit size while increasing power transmission, the maximum range of x can be chosen to be at least approximately [−25 cm, 25 cm], which may occur at a length of at least approximately fifty-one centimeters (51 cm) from the rocker arm 142 pivot point. This can be the position of the system when outputting the step length of at least approximately one hundred and two centimeters (102 cm). To synthesize a four-bar (4-bar) linkage 144 to produce the above output curve, Freudenstein's equation can be used as follows:

$$R_1\cos(\theta)-R_2\cos(\varphi)+R_3=\cos(\theta-\varphi)$$

where $$R_1 = \frac{d}{c}$$

$$R_2 = \frac{d}{a}$$

$$R_3 = \frac{a^2+c^2+d^2-b^2}{2ac}$$

and where a is the length of the crank 150; b is the length of the coupler; c is the length of the rocker arm 142; d is the length of the ground link, which is the distance between the fixed pivot on the crank 150 and the fixed pivot on the rocker; θ is the angle between the crank 150 and the ground link; and φ is the angle between the rocker arm 142 and the ground link. Using the trigonometric difference identities, Freudenstein's equation can be rewritten as follows:

$$\varphi = \operatorname{acos}\left[\frac{R_1\cos(\theta)+R_3}{A}\right]+\alpha$$

Assuming θ to be constant, the φ term can be isolated by combining the sine and cosine terms using linear summation:

$$R_1\cos(\theta)+R_3=A\cos(\theta-\alpha)$$

where $$A=\sqrt{[\cos(\theta)+R_2]^2+\sin^2(\theta)}$$

$$\alpha=a\tan[(\cos(\theta)+R_2)/\sin(\theta)]$$

Thus, the equation for the rocker arm angle in terms of the crank angle is given as follows:

$$R_1\cos(\theta)+R_3=\cos(\theta)\cos(\varphi)+\sin(\theta)\sin(\varphi)+R_2\cos(\varphi)$$

$$R_1\cos(\theta)+R_3=(\cos(\theta)+R_2)\cos(\varphi)+\sin(\theta)\sin(\varphi)$$

Figure 17:
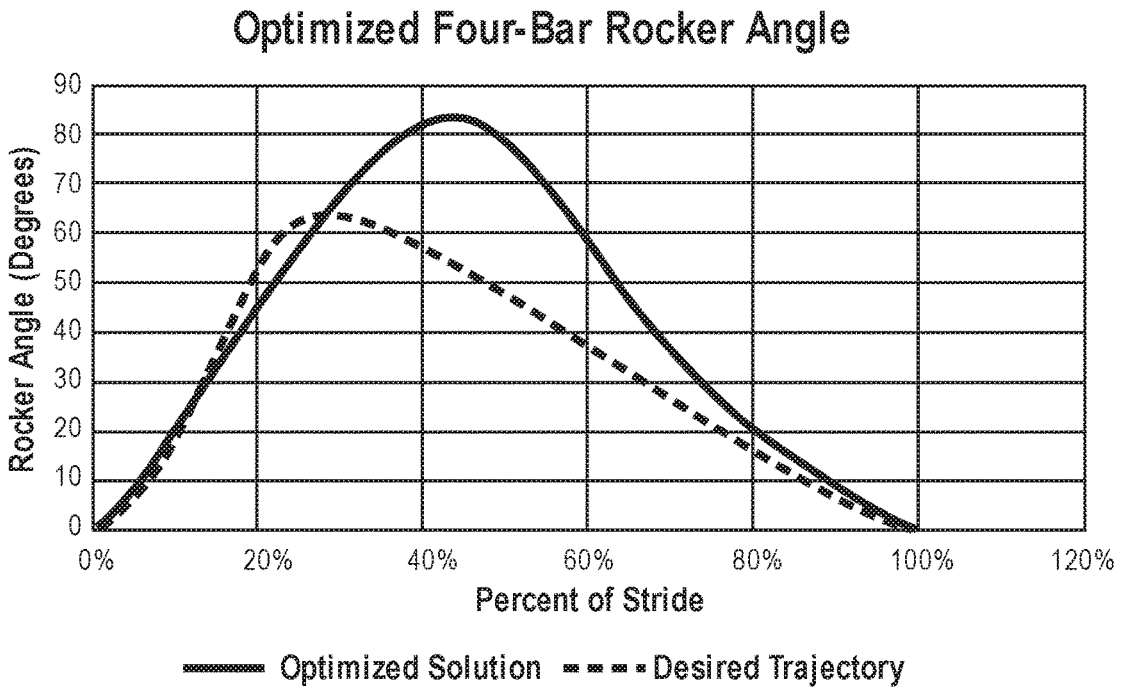
FIG. 17 is a graph illustrating a four-bar rocker angle in accordance with example embodiments of the present disclosure.

This equation can be least-squares curve fit to the phi angle calculated from the observed radial displacement of the foot. Constraints can be applied to meet the Grashof conditions for a crank-rocker. Also, to maximize backdrivability and power transmission, the crank 150 may not be less than at least approximately fifteen centimeters (15 cm) long in some embodiments. As a result, the crank length may be at least approximately fifteen and two-tenths centimeters (15.2 cm), the coupler may be at least approximately thirty-six and five-tenths centimeters (36.5 cm), the rocker arm may be at least approximately twenty-three and two-tenths centimeters (23.2 cm), and the ground link may be at least approximately forty-three and four-tenths centimeters (43.4 cm). The ground link can make at least approximately a minus forty-seven and eight-tenths degrees (−47.8°) angle with the horizontal. Example rocker angles are shown in FIG. 17.

Figure 18:
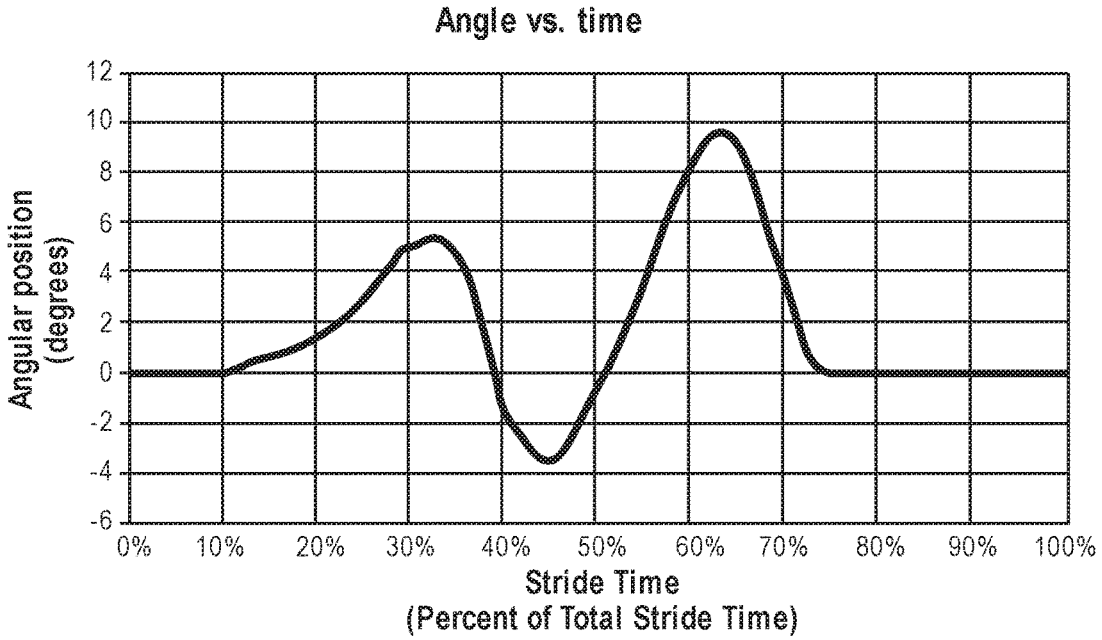
FIG. 18 is a graph illustrating beam angular position and cam in accordance with example embodiments of the present disclosure.
Figure 18:
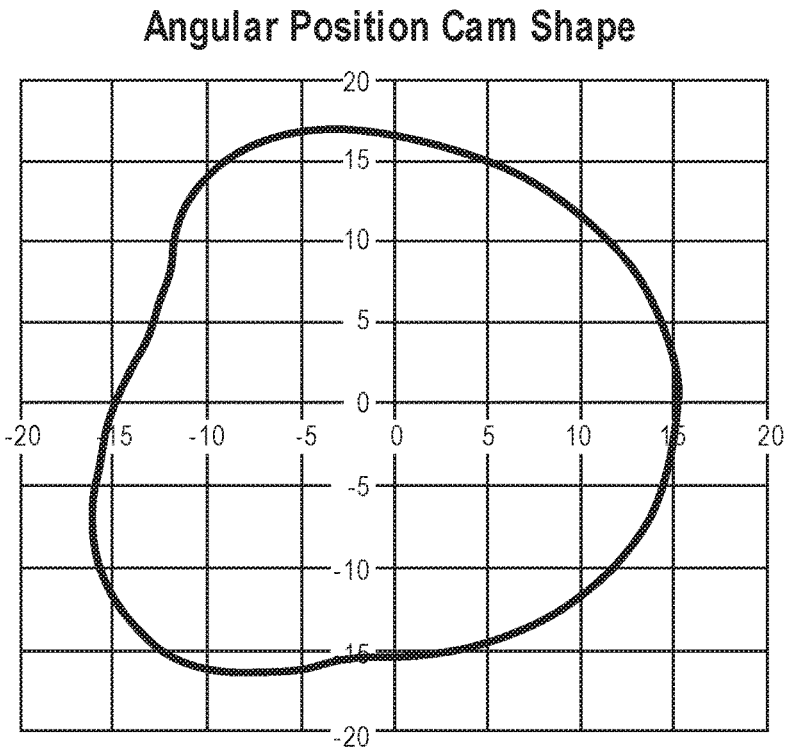

The timing for the four-bar linkage rocker angle can be similar to the desired timing of the radial motion of the foot pedal 118. In this manner, the crank rotation speed may be changed without use of a controller, and the crank 150 can rotate at a uniform angular velocity. Further, cams defining the angular position of the beam 112 and the vertical position of a secondary beam can be configured directly from displacement requirements (e.g., without consideration for cam rotation speed changes). In some embodiments, to use a roller follower with a cam, no point on the cam pitch curve may have a curvature smaller than the follower radius. With the cams 114 located halfway between the pivot point of the beam 112 and the end of the beam 112 (e.g., at least approximately twenty-five centimeters (25 cm) away), the cams may provide a maximum vertical movement of at least approximately four and four-tenths centimeters (4.4 cm). Example beam angle and cam profiles are shown in FIG. 18.

Figure 19:
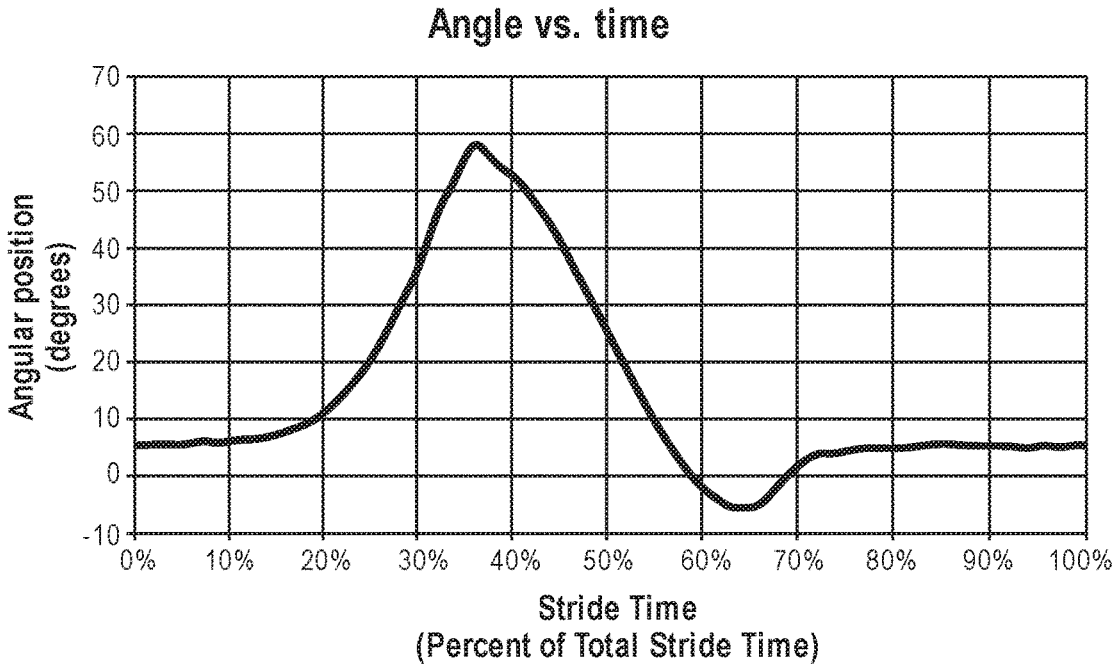
FIG. 19 is a graph illustrating foot orientation angle in accordance with example embodiments of the present disclosure.
Figure 21:
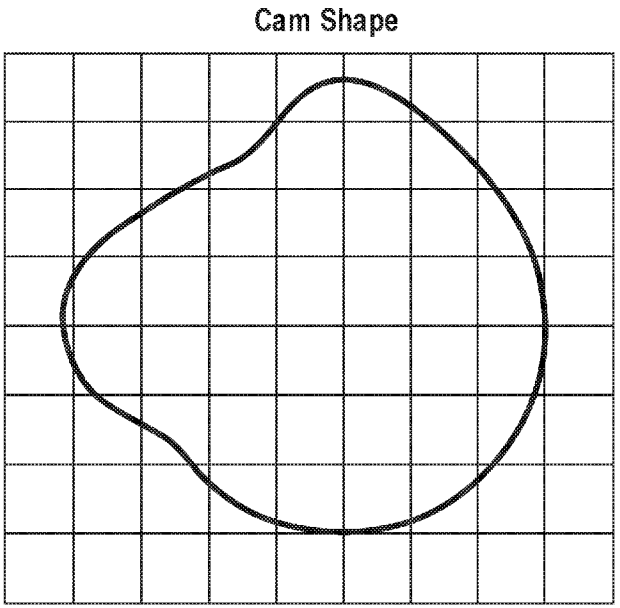
FIG. 21 is a graph illustrating cam shape for driving a foot orientation rail in accordance with example embodiments of the present disclosure.
Figure 20:
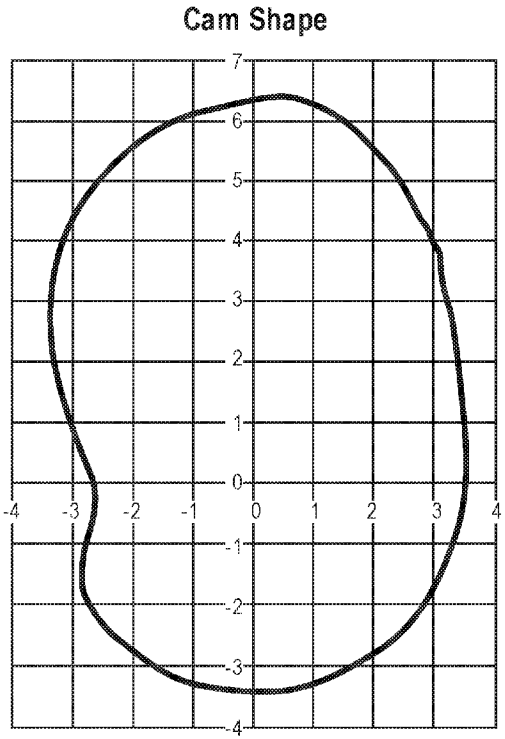
FIG. 20 is a graph illustrating cam shape for driving a foot orientation rail in accordance with example embodiments of the present disclosure.

In some embodiments, a foot orientation rail can be used to define the angle of the foot by rotating the foot pedal 118 relative to the foot position beam. Foot orientation angle is shown in FIG. 19. After accounting for the rotation of the foot positioning beam, a cam 114 that defines the motion of the foot orientation beam is shown in FIG. 20. Like the other cam, this cam 114 can be driven synchronously with the rest of the mechanism. Another cam 114 is illustrated in FIG. 21.

As described herein, apparatus 122 that mimic the foot trajectory of normal gait are described. In some embodiments, the apparatus 122 provides back-drivability, can be powered by a single motor (reducing weight and size), has linear scaling that is easy to adjust, and does not hinder children in a gait training scenario. In some embodiments, the chains 136 and/or cams can be enclosed (e.g., in a housing) to prevent or minimize contact with patients. In some embodiments, a gait replication apparatus 122 provides a gait-like trajectory that is adjustable for pediatric or adult users and adjustable for users with different gait lengths for each foot or increased/reduced step height. The apparatus 122 can be motorized and back drivable so users with poor muscle tone can benefit from the therapy and those with good muscle tone can use it as an exercise or therapy device.

As described herein, a four-bar linkage 144 can be attached to a rack 146 and pinion 148. Changing the location of the rack 146 and rocker bar connection effectively changes the gait length of the system. The rack 146 and pinion 148 is then attached via a chain 136 to the foot pedal 118, which travels along a beam 112, to advance the foot. Cams can be attached to the beam 112 to add vertical motion in the stride to accurately mimic a gait pattern. A motor can be used to move the foot pedals 118 by moving the crank arm (e.g., crank 150) of the four bar linkage, or the machine can be back driven if the motor is off. In the latter case, the motion of the foot pedal 118 drives the chain 136 attached to the rack 146 and pinion 148 to move the four bar linkage.

The gait replication apparatus 122 can be scalable to accommodate individuals with a wide range of step lengths, pediatric to adult. The gait replication apparatus 122 can be adjustable, with custom adjustment for those with uneven or unusual gait, different lengths for each foot, increased and/or reduced step heights, and so forth. Further, anatomically correct motion that accurately mimics natural gait motion can be provided. The gait replication apparatus 122 can also be used for assistive/resistive applications, where the equipment can be powered by a motor to varying degrees to fully or partially assist patients and/or can be powered by the user directly.

In some embodiments, gait replication apparatus 122 can be used for physical therapy and rehabilitation applications, where gait therapy is provided for victims of stroke, nervous system damage, Parkinson's disease, the elderly, or users with generally poor muscle tone, in settings including, but not necessarily limited to: rehabilitation hospitals (e.g., those serving pediatric and adult patients), nursing homes, and so on. Further, the gait replication apparatus 122 can be used in cardiovascular and exercise equipment applications, e.g., as a general physical fitness and/or cardiovascular exercise device. Similar applications can include elliptical exercise machines, treadmills, and so forth. Further, such apparatus 122 can be adjustable for use by an entire family.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A mobile foot pedal configured for use with a scalable gait replication apparatus, comprising:

a foot pedal carriage coupled to a four-bar linkage, the foot pedal carriage slidably coupled to an immobile beam;

a foot plate coupled to the foot pedal carriage, wherein the foot plate comprises a first set of rods coupled to the foot pedal carriage by a first revolute joint and a second set of rods coupled to the first set of rods by a second revolute joint, wherein the second revolute joint is configured to move along the mobile foot pedal to enable adjustment of a distance between the first and second revolute joints.

2. The mobile foot pedal as recited in claim 1, wherein the foot pedal carriage is coupled to a rocker within the four-bar linkage by at least one rod and a sliding linkage on the rocker configured to scale movement of the foot pedal carriage along the immobile beam.

3. A gait replication apparatus comprising:

a four-bar linkage comprising a rocker pivotally coupled to a fixed surface;

an immobile beam fixed with respect to the fixed surface; and a mobile foot pedal comprising:

a foot pedal carriage coupled to the rocker of the four-bar linkage, the foot pedal carriage slidably coupled to the immobile beam;

a foot plate coupled to the foot pedal carriage, wherein the foot plate comprises a first set of rods coupled to the foot pedal carriage by a first revolute joint and a second set of rods coupled to the first set of rods by a second revolute joint, wherein the second revolute joint is configured to move along the mobile foot pedal to enable adjustment of a distance between the first and second revolute joints.

4. The gait replication apparatus of claim 3, wherein the foot pedal carriage is coupled to the rocker of the four-bar linkage by at least one rod and a sliding linkage on the rocker configured to scale movement of the foot pedal carriage along the immobile beam.

5. The gait replication apparatus of claim 4, comprising a pin configured for fixing the slidable linkage to the rocker at one of a plurality of holes along the rocker.

6. The gait replication apparatus of claim 4, wherein the foot pedal carriage is coupled to the at least one rod at a rod-connecting revolute joint.

7. The gait replication apparatus of claim 4, wherein the four-bar linkage comprises a crank pivotally coupled to the rocker at a first end of the crank.

8. The gait replication apparatus of claim 7, wherein the four-bar linkage comprises a link pivotally coupled to a second end of the crank at a first end of the link.

9. The gait replication apparatus of claim 8, comprising a motor coupled to a second end of the link and configured to rotate the link to provide a gait-like trajectory at the mobile foot pedal.

10. A method for operating the gait replication apparatus of claim 3, the method comprising:

adjusting the mobile foot pedal of the gait replication apparatus for a user; and powering a motor of the gait replication apparatus to cause the gait replication apparatus to provide a gait-like trajectory to the user's foot at the mobile foot pedal.

11. The method of claim 10, wherein adjusting the mobile foot pedal comprises adjusting the distance between the first and second revolute joints based on a distance between the user's heel and metatarsal.

12. The method of claim 10, wherein the foot pedal carriage is coupled to the rocker of the four-bar linkage by at least one rod and a sliding linkage on the rocker configured to scale movement of the foot pedal carriage along the immobile beam, wherein the method comprises adjusting the gait replication apparatus to the user by fixing the slidable linkage to the rocker at one of a plurality of holes along the rocker with a pin.

* * * * *